US006075494A

United States Patent [19]

Milroy

[11] Patent Number: 6,075,494

[45] Date of Patent: Jun. 13, 2000

[54] COMPACT, ULTRA-WIDEBAND, ANTENNA FEED ARCHITECTURE COMPRISING A MULTISTAGE, MULTILEVEL NETWORK OF CONSTANT REFLECTION-COEFFICIENT COMPONENTS

[75] Inventor: William W. Milroy, Playa Del Rey, Calif.

[73] Assignee: Raytheon Company, Lexington, Mass.

[21] Appl. No.: 08/884,952

[22] Filed: Jun. 30, 1997

[51] Int. Cl.[7] ..... H01Q 13/02

[52] U.S. Cl. ..... 343/776; 343/785

[58] Field of Search ..... 343/776, 785, 343/772, 786, 770, 767

[56] References Cited

U.S. PATENT DOCUMENTS

| | | | |
|---|---|---|---|
| 2,628,311 | 2/1953 | Lindenblad | 343/776 |
| 2,822,541 | 2/1958 | Sichak et al. | 343/783 |
| 3,277,489 | 10/1966 | Blaisdell | 343/777 |
| 5,642,121 | 6/1997 | Martek et al. | 343/786 |

*Primary Examiner*—Don Wong
*Assistant Examiner*—James Clinger
*Attorney, Agent, or Firm*—Leonard A. Alkov; Glenn H. Lenzen, Jr.

[57] ABSTRACT

A true-time-delay corporate feed that minimizes both scan- and frequency-dependent variations in driving point impedance by realizing and exploiting a folded ensemble of intentionally mismatched E-plane tee junctions, E-plane steps, and E-plane bends that are used to form the antenna feed. A selected arrangement of E-plane tee junctions, E-plane steps, and E-plane bends are interconnected between a line-source interface that receives RF power and a plurality of line-source interfaces that couple the RF power to radiating stubs of a continuous transverse stub antenna array. The impedance of the individual mismatched components are set to be essentially constant and purely real, such that the feed network ensemble behaves as a multi-stage transformer, efficiently matching dissimilar radiator (load) and line-source (source) impedances over a broad range of operating frequencies and scan angles.

11 Claims, 2 Drawing Sheets

COMPACT, ULTRA-WIDEBAND, ANTENNA FEED ARCHITECTURE COMPRISING A MULTISTAGE, MULTILEVEL NETWORK OF CONSTANT REFLECTION-COEFFICIENT COMPONENTS

BACKGROUND

The present invention relates generally to antenna feed architectures, and more particularly, to an antenna feed architecture employing a folded multistage, multilevel network of dissimilar constant reflection-coefficient components, which serves to efficiently match dissimilar radiator (load) and line-source (source) impedance over a wide range of operating frequencies and scan angles.

The performance of E-plane bends, E-plane T-junctions and E-plane step transformers in conventional rectangular waveguide operating in a dominant $TE_{1,0}$ mode is described extensively in the literature. For example, see Montgomery, C. G., R. H. Dicke and E. M. Purcell (eds.), "Principles of Microwave Circuits" (MIT Radiation Lab. Ser. No. 8), pp. 188–191, 285, McGraw-Hill, New York, 1951, Marcuvitz, N. (ed.), "Waveguide Handbook" (MIT Radiation Lab. Ser. No. 10), pp. 307–310, 333–334, 336–350, McGraw-Hill, New York, 1951, Moreno, T., "Microwave Transmission Design Data", pp. 157–164, Artech House, Norwood, Mass., 1989, and Matthaei, G. L., L. Young and E. M. T. Jones, "Microwave Filters, Impedance Matching Networks, and Coupling Structures", pp. 258–259, 522–531 and 576–581, Artech House, Norwood, Mass., 1980. These elements are generally restricted to operating frequency bandwidths much less than 40 percent due to the inherent dispersive properties of rectangular waveguide structures. It is therefore conventional to utilize individually matched (minimized reflection coefficient) narrowband implementations of these devices an any integrated structure (such as a feed network) employing a plurality of these components.

Qualitatively, similar performance is obtained for such E-plane circuits that operate in the TEM mode in parallel-plate waveguide, or if the sides are bounded by conducting walls, in $TE_{m,0}$ modes. However, quantitatively, in contrast to rectangular waveguide implementations, parallel-plate implementations of E-plane bends, tees, and steps can exhibit multi-octave frequency ranges for which their individual impedance properties are essentially constant, due to the nondispersive nature of the parallel-plate structure. In addition, and again in contrast to rectangular waveguide implementations, H-plane scanning of the plane-wave radiating from the antenna structure can be easily realized in the single continuous transverse structure of the parallel-plate as compared to the difficulty in realizing H-plane scanning in a rectangular waveguide structure having numerous discrete, mutually-coupled, complex waveguide feeds. Likewise, the scanangle dependence of each stage is readily derived and therefore readily utilized in optimization of performance over scan angle.

Accordingly, it is an objective of the present invention to provide for an improved antenna feed architecture employing a folded multistage, multilevel network of constant reflection-coefficient components in order to realize a simple integrated feed structure capable of high efficiencies over a wide range of operating frequencies and scan ranges.

SUMMARY OF THE INVENTION

The driving point, or input impedance of an array of antenna elements depends strongly on both the isolated (i.e., self-impedance behavior) of the radiating element and the mutual coupling effects between the antenna elements of the array when all other elements are excited in a prescribed manner. A true-time-delay corporate feed architecture is provided by the present invention that minimizes both scan- and frequency-dependent variations in driving point impedance by realizing and exploiting the frequency-independent intentionally mismatched impedance of the constituent components that are used to form the antenna feed architecture, namely, E-plane bends, E-plane tees both single and multistage, multilevel, E-plane step transformers. The present invention provides for an improvement over the teachings of U.S. Pat. No. 5,266,961, entitled "Continuous Transverse Element Devices and Methods of Making Same", for example.

A desired impedance level of the components may be obtained uniquely and frequency-independently by a simple change in parallel-plate height, rather than ambiguously and frequency-dependently from multiple features in the waveguide. This allows the parallel-plate components to be used as elements from which to design compact corporate feeds that exhibit multi-octave, or even decade, operational bandwidths. For example, a reduced-to-practice eight-way, true-time-delay corporate feed was built using the design concept embodied in the present invention. The prototype feed was successfully tested over a 5 to 18 GHz bandwidth, with usable performance predicted over 3.5 to 20 GHz.

The present ultra-wideband corporate feed architecture was developed for use with a true-time-delay continuous transverse stub array antenna. On transmit, RF power is applied at a port of a parallel-plate waveguide. Power is divided in successive levels between two horizontal arms of each E-plane tee in direct proportion to their height ratio, which may be unity throughout. Alternatively, arbitrary non-uniform phase and/or amplitude divisions may be realized by altering the center and/or outputarm heights of the tee. Due to the simple relationship between waveguide height and impedance level, an n-stage, multilevel E-plane transformer design methodology is easily implemented. The reflection coefficient of the input port remains fairly constant over a wide range of frequencies.

In order to successfully achieve wide instantaneous bandwidth, transmission lines and other components of the corporate feed must be nondispersive, i.e., have negligible nonlinear phase and/or amplitude variations as a function of frequency. A parallel-plate waveguide is an example of a nondispersive TEM transmission line. A highly overmoded rectangular waveguide ($a \gg \lambda_0$) is essentially nondispersive except at very low frequencies.

Another advantage of the present feed architecture is that the combination of matching elements, E-plane steps, bends and tees, results in a lower profile geometry behind the aperture than if a straight, multistage step transformer were used. For example, a seven-stage feed built in accordance with the present invention has an overall depth of only 0.5 inch (or 0.8 inch for air dielectric), whereas an equivalent conventional feed would have a depth of 1.1 inches (1.75 inches for air dielectric). Also, by inserting an unmatched tee in the present architecture at stage #5 rather than a conventional step transformer, the impedance level and parallel-plate waveguide height of that and succeeding stages is raised to a more convenient level. Thus, the final section (i.e., section #7) of the new matching network has a height of 0.067 inch compared to 0.035 inch for the conventional design. The relative thickness and parallel-plate height advantages of this "folded-integrated" architecture become more pronounced in implementations as the bandwidth increases.

Following is a summarization of the key advantages of the present invention. The design methodology of the present feed architecture exploits the constant impedance characteristics of the source and the continuous transverse stub radiators. The problem is then reduced to a multistage transformer design, which is optimized to be compact and realizable.

Unlike conventional implementations employing individually matched elements, E-bends and tees are intentionally mismatched, which allows the feed structure to be folded in the "z" direction (direction of energy propagation), thereby reducing the depth in the "x" direction (radiating direction) by effectively extending multiple transforming states across multiple levels. The mismatched components are designed to cancel the reactive components, so that only "pure real" impedance steps remain, thereby enhancing the operating bandwidth. Overall bandwidth is maximized and thickness minimized by using reduced-height E-plane tees.

Stages closest to the continuous transverse stub radiators are unique in that the multiple stages are folded and integrated with the intentionally mismatched E-plane bends and tees in order to form an integrated matched, multistage subcomponent extending across multiple layers of the feed network. The number of stages that may be used is essentially unlimited. Stages further away from the aperture, where horizontal extents of parallel-plate are larger, also utilize novel intentionally mismatched E-plane bends and tees, such as are disclosed in copending U.S. patent application Ser. No. 08/885,583, filed Jun. 30, 1997, entitled "Planar Antenna Radiating Structure Having Quasi-Scan, Frequency-Independent Driving-Point Impedance", assigned to the assignee of the present invention, but with a common in-line (unfolded) multi-stage step transforming section. The relative impedance of adjacent "stages" is selected in order to achieve the desired tapered frequency response (Chebyshev, uniform, binomial, etc.) as is convention in common multi-stage transformers.

H-plane scanning may be directly accomplished due to the continuous nature (i.e., uniform cross section) in the "y" direction. Interelement spacing (in the "z" direction) can be chosen to avoid the onset of grating lobes while scanning. The throat dimension of the E-bends can be chosen to prevent bleed through of higher-order modes.

The present feed architecture takes advantage of several unique properties of continuous parallel-plate structures and overmoded waveguides. This results in significant design, producibility and cost benefits when compared to conventional waveguide or transmission line structures. 2N versus $N^2$ complexity is provided by the present invention. An N-way, H-plane feed may be used to feed an N-way, E-plane, parallel-plate feed. Design and recurring costs are much less than for a conventional $N^2$ corporate feed with discrete radiating elements. Simpler and lower-cost fabrication processes can be used, such as extrusions, castings and injection molding processes. The propagation constant of a waveguide operating in a fundamental mode is sensitive to the "a" dimension of the waveguide, including an undesirable cut-off phenomenon. Parallel-plate structures and highly-overmoded waveguides, on the other hand, are insensitive to both the "a" and "b" dimensions of their structures. Parallel-plate structures and overmoded waveguides have lower loss than conventional waveguides and much less loss than stripline, microstrip and coplanar waveguides. This is increasingly important at higher millimeter wave frequencies. The continuous H-plane cross section simplifies analysis and the implementation of scanning, wherein simple geometric optic may be employed, in contrast to the complex mutual impedance formulations required when employing multiple discrete rectangular waveguide feeds.

The ultra-wideband antenna feed architecture may be used to create waveguide feed networks for antennas such as a true-time-delay continuous transverse stub array antenna. The present architecture was successfully used to produce a wideband continuous transverse stub array that operates over the extended band of 3.5 to 20.0 GHz.

The present invention may be used in multifunctional military systems or high-production commercial products where a single ultra-wideband aperture is used to replace several narrowband antennas such as in a point-to-point digital radio, or global broadcast satellites (GBS). Also, the cross section of the present invention is invariant in one dimension, and it may be made using inexpensive, high-volume fabrication techniques such as extrusion processes or plastic injection molding processes.

In addition, due to the TEM nature of the parallel-plate propagation, multiple longitudinal seams or breaks in the conducting surfaces enclosing the feed structure may be tolerated without penalty in operation. Likewise, precise conductive sealing of the perimeter of the feed in non-critical, in direct contrast to the critical nature of such joints in rectangular waveguide structures.

BRIEF DESCRIPTION OF THE DRAWINGS

The various features and advantages of the present invention may be more readily understood with reference to the following detailed description taken in conjunction with the accompanying drawings, wherein like reference numerals represent like structural elements, and in which.

DETAILED DESCRIPTION

Figure 1:
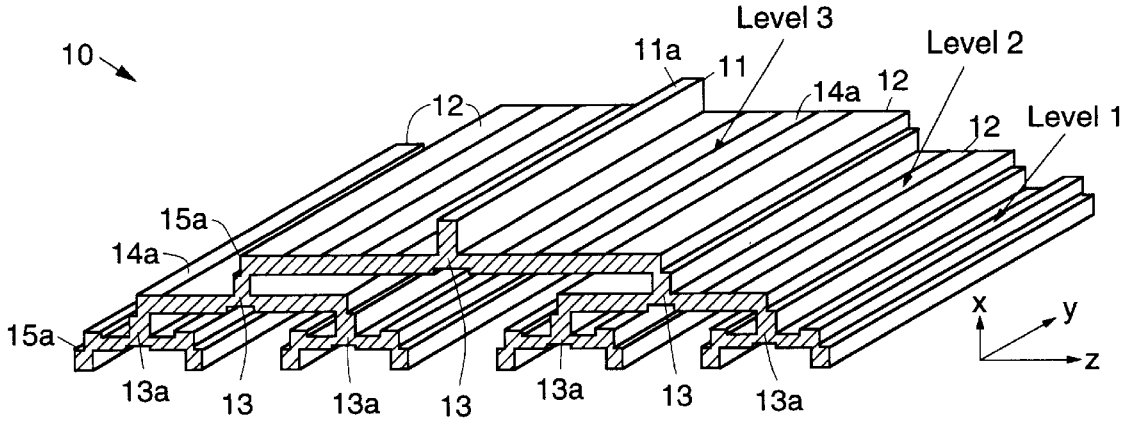
FIG. 1 illustrates shows an eight-way, true-time-delay corporate feed in accordance with the principles of the present invention fabricated using low-loss microwave dielectric.

Referring to the drawing figures, FIG. 1 shows one embodiment of a true-time-delay ultra-wideband corporate feed architecture 10 in accordance with the principles of the present invention. More specifically, FIG. 1 shows an eight-way, true-time-delay corporate feed 10 fabricated using a low-loss microwave dielectric such as Rexolite®. Dielectric components are bonded together, then the external surfaces are uniformly metalized with an RF conductor such as silver or aluminum, to form a parallel-plate waveguide feed structure. Three levels (level 1, level 2, level 3) of the corporate feed architecture 10 are shown in FIG. 1.

Alternative techniques for fabrication of air-dielectric parallel-plate waveguide structures may also be employed to produce the present invention. In addition to the design described herein, fabricated in dielectric-filled parallel-plate waveguide, a second design, fabricated as an air-filled structure, has bee successfully demonstrated. Alternatively, partially-filled implementations may also be produced. Design methodologies for using E-plane step transformers to achieve wideband matching are described in the literature. However, the present invention improves the wideband matching by incorporating unmatched E-plane step transformers 14*a*, unmatched E-plane bends 15*a* and unmatched E-plane tee junctions 13*a* in the true-time-delay corporate feed 10.

The present ultra-wideband corporate feed architecture 10 was developed for use with a true-time-delay continuous transverse stub array antenna utilizing a wideband continuous transverse stub radiator (not shown). On transmit, RF power is applied at a port 11*a* (line-source interface 11*a*) of a parallel-plate waveguide 11 shown along the top of the feed 10 in FIG. 1. Power is divided in successive feed levels between two horizontal arms 12 of each E-plane tee junction 13, 13*a* in direct proportion to their height ratio, which for the example shown is unity throughout. Due to the simple relationship between waveguide height and impedance level, an n-stage, multilevel E-plane transformer design methodology is easily implemented. The reflection coefficient of the input port 11 a remains fairly constant over a wide range of frequencies.

To achieve wide instantaneous bandwidth, transmission lines and other components of the corporate feed 10 must be nondispersive, i.e., have negligible nonlinear phase and amplitude variations as a function of frequency. A parallel-plate waveguide is a nondispersive TEM transmission line. A highly overmoded rectangular waveguide ($a \gg \lambda_0$) normally operates far from cutoff, so it is essentially nondispersive except at very low frequencies.

Figure 2:
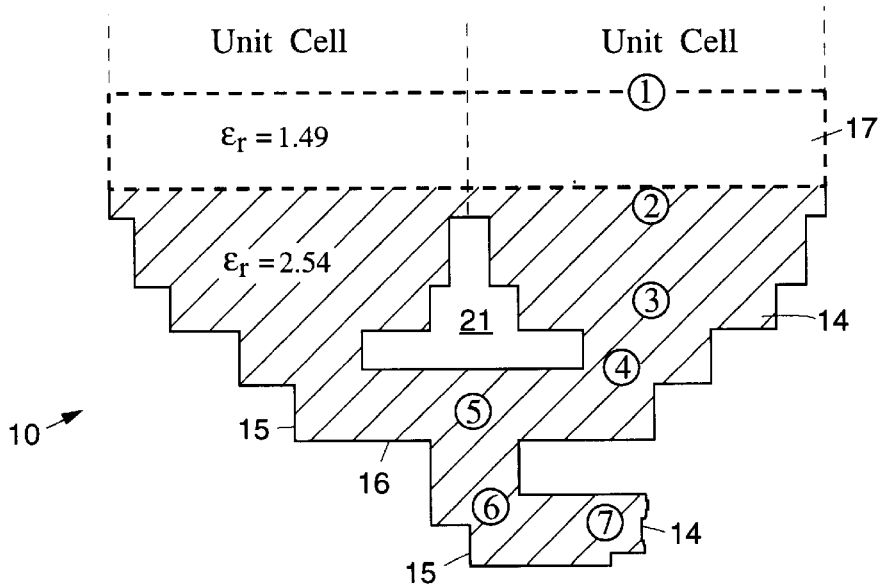
FIG. 2 illustrates a cross sectional view of an integrated first portion (level 1) of the true-time-delay feed of FIG. 1.

FIG. 2 shows a cross section for a portion of level 1 (i.e., the level nearest to continuous transverse stub radiators of the continuous transverse stub array antenna) of the true-time-delay feed 10 of FIG. 1. As is shown in FIG. 2, wideband matching is achieved in level 1 using a folded seven-stage combination of parallel-plate waveguide E-plane step transformers 14, bends 15 and a tee junction 16. An optional foam layer 17 may be provided at the uppermost stage (stage 1). The effective interface locations (i.e., phase centers) bounding six stages of matching over the folded convoluted are designated by the seven circled numbers shown in FIG. 2.

Figure 3:
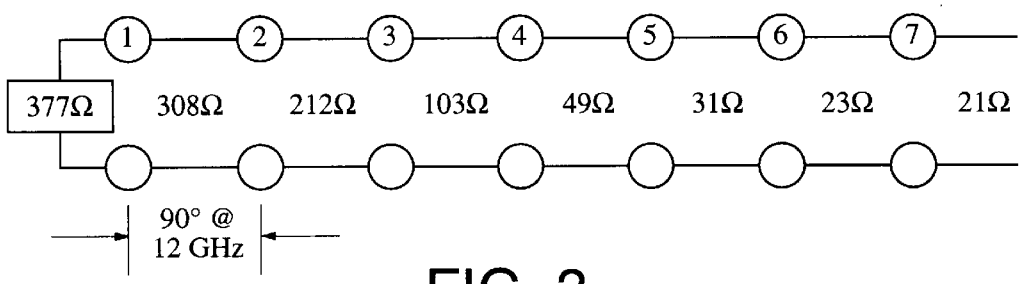
FIG. 3 is a schematic representation of the folded multi-stage level 1 matching architecture.

FIG. 3 is an "unfolded" schematic representation of the level 1 matching architecture. FIG. 3 illustrates a seven-stage matching network, showing interstage impedance levels used in a typical design. In FIG. 3, "1" represents an interface between free space (377 Ω) and the optional foam layer 17 (308 Ω). "2" represents the interface between the optional foam layer 17 and the Rexolite dielectric comprising the parallel-plate waveguide (212 Ω). "3" represents the matched continuous transverse stub radiator 21 (103 Ω). "4" represents a first unmatched E-plane bend 15*a* (49 Ω). "5" represents the unmatched E-plane tee junction 16*a* (31 Ω). "6" represents the second unmatched E-plane bend 15*a* (23 Ω). Lastly, "7" represents the step transformer 14*a* (21 Ω). The parallel-plate waveguide height for each stage is displayed above and adjacent to it. The height shown for stages "1" through "4" is identical, both for the matching structure shown in FIG. 2 and for a conventional seven-stage step transformer. However, the height for stages "5" through "7" is different in the present invention (the "*" adjacent to the height value designates the height for the conventional design) due to replacing the conventional step transformer 14 of section "5" with the unmatched tee junction 16. The final section (i.e., #7) of the present matching network has a height of 0.067 inch compared to 0.035 inch for the conventional design, due to the advantageous renormalization provided by the unmatched tee junction 16. Also, the presence of additional step features at interfaces "2" and "3", whose function is to realize pure real reflection coefficients (i.e., cancel susceptance components at these two interfaces).

Thus, the present feed architecture 10 E-plane step transformers 14, unmatched E-plane bends 15 and unmatched tee junctions 16, to produce a folded lower profile geometry behind the aperture than if a conventional, multistage step transformer were used. For example, the seven-stage feed 10 shown in FIG. 2 has an overall depth of only 0.5 inch (or 0.8 inch using air dielectric), whereas an equivalent conventional feed would have a depth of 1.1 inches (1.75 inches using air dielectric). Also, by inserting the unmatched tee junction 16 in the feed architecture 10 at stage #5 rather than a conventional step transformer, the impedance level and parallel-plate waveguide height of that and succeeding stages is raised to a more convenient level. Thus, the final section (i.e., #7) of the matching network has a height of 0.067 inch compared to 0.035 inch for the conventional design. The relative thickness and parallel-plate height advantages of this "folded-integrated" architecture 10 become more pronounced in implementations as the bandwidth increases.

Figure 4:
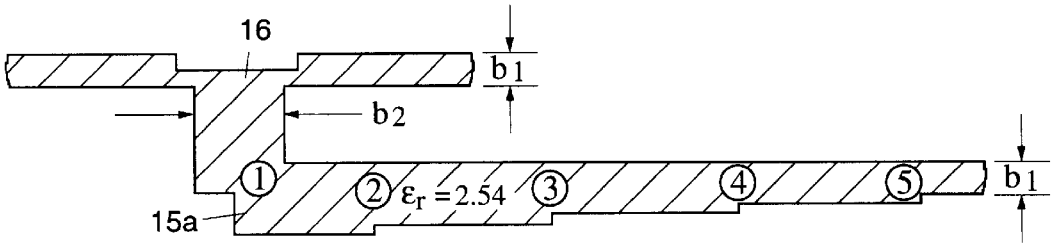
FIG. 4 shows a cross sectional view of a second portion (level 3) of the truetime-delay feed of FIG. 1.

FIG. 4 shows a cross sectional view of a portion (level 3) of the true-time-delay feed 10 of FIG. 1. FIG. 4 illustrates that wideband matching is achieved in level 3 using a combination of collinear parallel-plate waveguide E-plane steps that form multistage step transformer 14*a*, an unmatched E-plane bend 15*a* and a specialized wideband tee junction 16. FIG. 4 shows a cross section for part of level 3 (i.e., the level nearest to the parallel-plate waveguide line-source interface 11*a* or port 11*a*) of the true-time-delay feed 10. A specialized wideband matched E-plane tee junction 16 is combined with a multistage step transformer 14*a* whose function it is to transform the wider input arm (width "$b_2$") of the matched tee junction 16 back to a size identical with collinear output arms of the tee junction 16 (width "$b_1$"). The specialized wideband matched E-plane tee junction 16 is described in copending U.S. patent application Ser. No. 08/884,837, filed Jun. 30, 1997, entitled "Compact, Ultra-Wideband, Matched E-plane Power Divider", assigned to the assignee of the present invention. The four interfaces of matching elements are again designated by circled numbers. "1" represents a unmatched E-plane bend 15*a*. "2", "3", "4" and "5" represent step transformers 14*a*. The matching structure is similar to a conventional four-stage step transformer, except stage "1" is replaced by the unmatched E-plane bend 15*a*. This tee/transformer assembly is common for both level 2 and level 3 of the feed 10.

Figure 5:
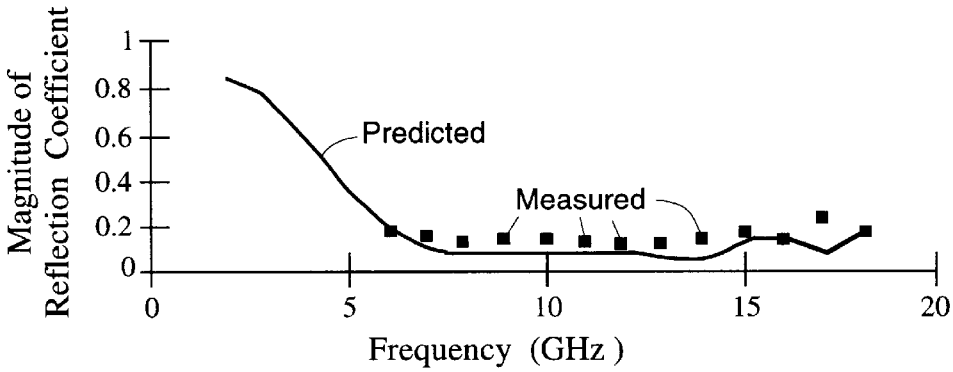
FIG. 5 shows predicted and measured magnitude of reflection coefficient (Gamma) as a function of frequency of the true-time-delay feed of FIG. 1.
Figure 6:
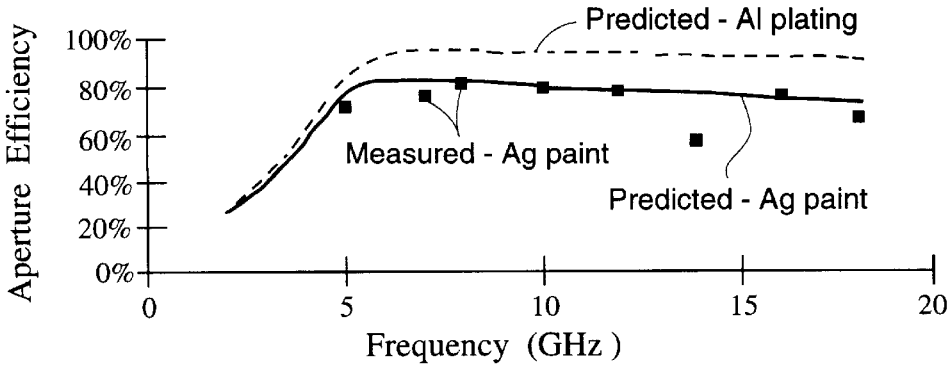
FIG. 6 illustrates predicted and measured aperture efficiency (excluding external line feed losses) as a function of frequency for the true-time-delay corporate feed in accordance with the principles of the present invention.

A four-level, 16-way true-time-delay corporate feed 10 similar to that shown in FIG. 1 was used to excite an array antenna having 16 continuous transverse stub radiators. The antenna was measured from 6.0 to 18.0 GHz for patterns, gain, efficiency and input reflection coefficient (gamma). The predicted and measured magnitude of the input reflection coefficient (Gamma) as a function of frequency is shown in FIG. 5. The data validate the excellent wideband performance of the matching structure of the present parallel-plate waveguide feed 10.

The predicted and measured efficiency, excluding external line feed losses, as a function of frequency of the four-level, 16-way true-time-delay corporate feed 10 is shown m FIG.

6. The point at 14 GHz is believed to be a measurement error. However, the data validate the excellent wideband efficiency of the matching structure of the parallel-plate waveguide feed 10 and continuous transverse stub array antenna.

Thus, an improved antenna feed architecture employing a folded multistage, multilevel network of dissimilar constant reflection-coefficient components has been disclosed. It is to be understood that the described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A true-time-delay ultra-wideband corporate feed for use with a continuous transverse stub antenna array, said corporate feed comprising:

a line-source interface for receiving RF power;

a selectively interconnected plurality of matched and unmatched E-plane step transformers, matched and unmatched E-plane bends and matched and unmatched E-plane tee junctions formed as a plurality of layers, and wherein the impedance of the mismatched components cancels the impedance of the reactive components, so that only pure real impedance steps, and negligible phase variations as a function of frequency are present; and a plurality of line-source interfaces for coupling the RF power to stubs of the continuous transverse stub antenna array.

2. The corporate feed of claim 1 wherein a desired impedance level is obtained by changing the height of the respective transformers, E-plane bends, and E-plane tee junctions.

3. The corporate feed of claim 1 wherein the E-plane bends and tee junctions are intentionally mismatched to allow the feed structure to be folded in the direction of energy propagation, thereby reducing the depth in the radiating direction.

4. The corporate feed of claim 1 wherein the overall bandwidth of the corporate feed is maximized and thickness minimized by using reduced-height E-plane tee junctions.

5. The corporate feed of claim 1 wherein the both scan- and frequency-dependent variations in driving point impedance is minimized.

6. The corporate feed of claim 1 wherein power is divided in successive levels between horizontal arms of each E-plane tee junction in direct proportion to their height ratio.

7. The corporate feed of claim 1 wherein stages closest to the continuous transverse stub radiators are folded and integrated with the intentionally mismatched E-plane bends and tee junctions to form a matched, multistage subcomponent.

8. The corporate feed of claim 1 wherein output heights and/or input positions of selected matched and unmatched E-plane tee junctions are modified to produce a desired nonuniform phase and/or amplitude distribution for the corporate feed.

9. The corporate feed of claim 1 wherein the selectively interconnected plurality of matched and unmatched E-plane step transformers, matched and unmatched E-plane bends and matched and unmatched E-plane tee junctions have a solid dielectric cross-section.

10. The corporate feed of claim 1 wherein the selectively interconnected plurality of matched and unmatched E-plane step transformers, matched and unmatched E-plane bends and matched and unmatched E-plane tee junctions have a partially-filled dielectric cross-section.

11. The corporate feed of claim 1 wherein the selectively interconnected plurality of matched and unmatched E-plane step transformers, matched and unmatched E-plane bends and matched and unmatched E-plane tee junctions have an air-filled dielectric cross-section.

* * * * *